US009072639B2

(12) United States Patent
Essers

(10) Patent No.: US 9,072,639 B2
(45) Date of Patent: Jul. 7, 2015

(54) PAD, IN PATICULAR FOR A MATTRESS IN THE NURSING CARE AND HOSPITAL SECTOR

(75) Inventor: Heinz-Willy Essers, Wassenberg (DE)

(73) Assignee: Heinrich Essers GmbH & Co. KG, Wassenberg (DE)

( * ) Notice: Subject to any disclaimer, the term of this patent is extended or adjusted under 35 U.S.C. 154(b) by 362 days.

(21) Appl. No.: 13/575,721

(22) PCT Filed: Mar. 4, 2011

(86) PCT No.: PCT/EP2011/053268
§ 371 (c)(1),
(2), (4) Date: Jul. 27, 2012

(87) PCT Pub. No.: WO2011/107579
PCT Pub. Date: Sep. 9, 2011

(65) Prior Publication Data

US 2012/0297545 A1 Nov. 29, 2012

(30) Foreign Application Priority Data

Apr. 3, 2010 (DE) ..... 10 2010 002 572

(51) Int. Cl.
*A47C 27/15* (2006.01)
*A61G 7/057* (2006.01)
*A47C 27/00* (2006.01)
(Continued)

(52) U.S. Cl.
CPC ..... *A61G 7/05715* (2013.01); *A47C 27/005* (2013.01); *A47C 27/007* (2013.01); *A47C 27/15* (2013.01); *A47C 31/006* (2013.01); *A61G 7/047* (2013.01)

(58) Field of Classification Search
CPC .... A47C 27/005; A47C 27/007; A47C 27/15; A47C 31/006; A61G 7/05715
USPC ..... 5/691, 699, 724, 737, 738, 740, 652.1, 5/655.9, 484, 499, 500
See application file for complete search history.

(56) References Cited

U.S. PATENT DOCUMENTS 819,903 A * 5/1906 Maussner ..... 5/690
4,031,579 A * 6/1977 Larned ..... 5/652.1
(Continued)

FOREIGN PATENT DOCUMENTS

DE 203 06 348 U1 9/2003
DE 203 09 795 U1 10/2003
(Continued)

OTHER PUBLICATIONS

Translation of DE 20306348 U1, date Oct. 16, 2003.*

*Primary Examiner* — Michael Trettel
(74) *Attorney, Agent, or Firm* — McGlew and Tuttle, P.C.

(57) ABSTRACT

A pad, in particular for a mattress in the nursing care and hospital sector has a liquid-impermeable and elastic lower layer and a liquid-permeable and elastic upper layer arranged on the lower layer. The lower layer and the upper layer are surrounded by an outer casing, which has a liquid-impermeable outer casing lower part facing the lower layer and a liquid-permeable outer casing upper part facing the upper layer. The pad is very comfortable to lie and/or sit on and has a high degree of breathability. Moreover, the pad is easy to clean and can accordingly be reprocessed frequently. The pad can be easily and economically retrofitted to improve the lying comfort and the breathability of existing mattresses.

19 Claims, 4 Drawing Sheets

(51) Int. Cl.
*A47C 31/00* (2006.01)
*A61G 7/047* (2006.01)

(56) References Cited

U.S. PATENT DOCUMENTS

| | | | | | |
|---|---|---|---|---|---|
| 4,965,900 | A | * | 10/1990 | Smith | 5/695 |
| 5,817,391 | A | * | 10/1998 | Rock et al. | 428/86 |
| 5,870,785 | A | * | 2/1999 | Hoorens | 5/652.1 |
| 8,490,233 | B2 | * | 7/2013 | Essers | 5/724 |
| 8,572,785 | B2 | * | 11/2013 | Christan | 5/740 |
| 2006/0189955 | A1 | | 8/2006 | Miskie | |
| 2011/0283459 | A1 | | 11/2011 | Essers | |
| 2012/0324651 | A1 | * | 12/2012 | Essers | 5/691 |

FOREIGN PATENT DOCUMENTS

| | | | | | |
|---|---|---|---|---|---|
| DE | 10 2005 060 931 | A1 | | 6/2007 | |
| DE | 100 26 405 | B4 | | 2/2008 | |
| DE | 10 2007 059 274 | A1 | | 6/2009 | |
| DE | 10 2009 014265 | A1 | | 8/2010 | |
| EP | 1733651 | A1 | * | 12/2006 | A47C 21/06 |
| WO | 94/20002 | A1 | | 9/1994 | |
| WO | 96/32526 | A1 | | 10/1996 | |

* cited by examiner

PAD, IN PATICULAR FOR A MATTRESS IN THE NURSING CARE AND HOSPITAL SECTOR

CROSS REFERENCE TO RELATED APPLICATIONS

This application is a United States National Phase application of International Application PCT/EP2011/053268 and claims the benefit of priority under 35 U.S.C. §119 of German patent application DE 10 2010 002 572.0 filed Mar. 4, 2010, the entire contents of which are incorporated herein by reference.

FIELD OF THE INVENTION

The invention relates to a pad, in particular for use in the nursing care and hospital sector.

BACKGROUND OF THE INVENTION

Pads are used for people to sit and/or lie on comfortably and may, for example, be placed on conventional chairs or mattresses in order to improve their sitting and/or lying properties. In the nursing care and hospital sector, pads of this type have to fulfill further requirements. Apart from comfortable sitting and/or lying properties, pads of this type have to be robust and easy to clean, so that frequent reprocessing is possible.

SUMMARY OF THE INVENTION

The invention is based on an object of providing a comfortable pad, which allows frequent and easy reprocessing.

This object is achieved by a pad, in particular for a mattress in the nursing care and hospital sector, comprising a liquid-impermeable and elastic lower layer, a liquid-permeable and elastic upper layer arranged on the lower layer, an outer casing covering the lower layer and the upper layer comprising a liquid-impermeable outer casing lower part facing the lower layer, wherein the outer casing lower part is configured in the form of a trough, and a liquid-permeable outer casing upper part facing the upper layer. Owing to the liquid-permeable or fluid-permeable outer casing upper part being used as a sitting and/or lying surface, liquids can flow away from the sitting and/or lying surface into the interior of the fluid-permeable or liquid-permeable and elastic upper layer. Moreover, the fluid-permeable outer casing upper part and the upper layer are breathable, so that, on the one hand, climate control takes place and, on the other hand, high oxygen quantities can be brought to particularly endangered wound regions. Because of the fluid-impermeable or liquid-impermeable lower layer, liquid cannot penetrate from the upper layer into the lower layer, so the latter is not soiled in its interior. Owing to the elasticity of the lower layer, improved sitting and/or lying comfort is achieved, which is advantageous, in particular for a pressure-relieving soft support in connection with a decubitus prophylaxis and/or therapy. Liquid cannot escape through the outer casing lower part owing to the fluid-impermeable or liquid-impermeable outer casing lower part, so items arranged therebelow, such as, for example, a conventional mattress or a chair, are not soiled. The configuration of the outer casing lower part in the form of a trough allows a large liquid quantity to be stored without said liquid escaping laterally. The outer casing lower part preferably has liquid-impermeable side cheeks, which extend to the outer casing upper part.

The upper layer and the outer casing upper part are liquid-permeable and air-permeable, so liquid from the sitting and/or lying surface can flow away into the interior of the upper layer and good climate control can be achieved on the sitting and/or lying surface. The lower layer and the outer casing lower part are liquid-impermeable, so items arranged under the pad are not soiled. The lower layer and/or the outer casing lower part may be air-permeable or air-impermeable.

To reprocess the pad, the outer casing can be removed from the lower layer and the upper layer. For this purpose, the outer casing, for example, has a zip fastener, which is arranged between the outer casing lower part and the outer casing upper part. Only the outer casing and the fluid-permeable upper layer have to be completely cleaned during the reprocessing. The fluid-impermeable lower layer, which, because of the liquid collecting in the region of the outer casing lower part, is subject to more difficult soiling conditions, merely has to be cleaned on the outside, so simple reprocessing is possible.

In particular, the pad according to the invention can be used to improve the sitting and/or lying properties of existing seat cushions and/or mattresses, in that the pad is additionally arranged thereon. A retrofitting of this type of existing seat cushions and/or mattresses, in comparison to a completely new seat cushion or a completely new mattress, is comparatively economical, which is of great importance, in particular in the nursing care and hospital sector.

The pad preferably has a pad height of 10 mm to 200 mm, in particular from 20 mm to 150 mm. The sitting and/or lying comfort of the pad increases with an increasing pad height, as a better pressure distribution and greater spring deflections are achieved by this, in particular in the case of a concentrated load.

The lower layer and the upper layer are, in particular, arranged one above the other in a shear-resistant manner, which is achieved, for example by an anti-slip coating and/or a partial provision of the side of the lower layer facing the upper layer with knobs.

A pad, in which the upper layer has at least one spacer textile, in particular a warp-knitted spacer fabric and/or a weft-knitted spacer fabric, has a high degree of sitting and/or lying comfort and breathability. Moreover, the at least one spacer textile, in particular the at least one warp-knitted spacer fabric and/or weft-knitted spacer fabric, can be easily cleaned.

A pad, in which the upper layer has at least one knitted spacer fabric, which has two covering layers connected to one another by spacer threads, wherein the spacer threads form thread groups running in a plane, with an IXI-shape, is extremely robust and comfortable. The knitted spacer fabric, because of the IXI-shape of the large number of spacer thread groups, has a high degree of pressure elasticity and dimensional stability. Pressure loads can be resiliently absorbed by the spacer threads, with these returning to the original shape again after the pressure loading has ceased. Because of the high degree of dimensional stability, the knitted spacer fabrics can be configured with a height of 2 to 100 mm, in particular from 5 to 80 mm, in particular from 15 to 60 mm and in particular from 20 to 50 mm, without the latter being permanently deformed because of the pressure loads.

A pad, in which the upper layer has a plurality of warp-knitted and/or weft-knitted spacer fabrics, which are arranged horizontally next to one another and/or vertically above one another, improves the soft support and the lying comfort. The warp-knitted spacer fabrics or weft-knitted spacer fabrics may have the same or different compression hardnesses. Adjacent warp-knitted spacer fabrics or weft-knitted spacer fabrics may be fixed relative to one another. This may, for example, take place by means of coatings and/or rigid connections and/or releasable connections. Releasable connections are, for example, adhesive, hook and loop-type or zip fastener connections. Rigid connections are, for example, welded or seam connections.

A pad, in which the upper layer has at least one warp-knitted spacer fabric and/or a weft-knitted spacer fabric, which, in a horizontal direction, has a plurality of zones with different densities in such a way that the zones have different compression hardnesses, allows body support regions to be configured with different compression hardnesses. As a result, the pressure distribution of the pad can be optimized. Moreover, an edge strip for sitting on can be formed by an edge-side zone with increased compression hardness. The edge strip may, for example, be formed at the edge of a lower side, an upper side and/or the longitudinal sides of the upper layer. Furthermore, joints running in the longitudinal and/or transverse direction can be formed by zones with low compression hardness. The pad can be bent more easily owing to joints of this type in order, for example, to convert a lying surface into a sitting surface.

A pad, in which the lower layer has at least one elastic shaped body, which is surrounded by at least one liquid-impermeable shaped body casing, easily allows the fluid-impermeable and elastic lower layer to be formed. The liquid-impermeable or fluid-impermeable shaped body casing consists, for example of polyester with an outer polyurethane coating. The shaped body may be single-part or multi-part, it being possible for a plurality of shaped bodies to be covered by one or more shaped body casings. Moreover, the lower layer may be formed in such a way that a plurality of shaped bodies is arranged next to one another and/or above one another. The shaped bodies may be covered by a common shaped body casing. Alternatively, a plurality of shaped body casings may be provided, each covering one or more shaped bodies. The shaped body may be made of an open-pore and/or closed-pore foam, such as, for example, polyurethane (PU) with a specific gravity (Sp. Gr.) between (Sp. Gr. 30) and (Sp. Gr. 90), in particular (Sp. Gr. 45) and (Sp. Gr. 80).

A pad, in which the shaped body is made of foam, is simply constructed and economical.

A pad, in which the shaped body casing is permanently closed, is simply constructed and protects the shaped body effectively against soiling. The shaped body casing is, for example, welded. To clean the shaped body casing, it can be disinfected by wiping. If a plurality of shaped bodies with associated shaped body casings is provided, each of the shaped body casings may be permanently closed.

A pad, in which the shaped body casing can be removed from the shaped body, and in particular the shaped body casing has a zip fastener for removal from the shaped body, allows easy and thorough reprocessing of the lower layer. For the reprocessing, the shaped body casing is removed from the shaped body and replaced by a separately cleaned shaped body casing. The shaped body casing has a zip fastener for easy removal from the shaped body. The zip fastener is, for example, protected against liquid passing through by overlapping material fabrics. If a plurality of shaped bodies with associated shaped body casings are provided, each of the shaped body casings may be removable, in particular have a zip fastener.

A pad, in which the lower layer has a plurality of elastic shaped bodies, which are arranged horizontally next to one another and/or vertically above one another, allows a flexible construction of the lower layer with different strength zones in the horizontal and vertical direction. A common shaped body casing is, for example, provided to cover the shaped bodies. Alternatively, individual and/or a plurality of shaped bodies in the horizontal and/or vertical direction may have their own shaped body casings.

A pad, in which the shaped bodies arranged vertically above one another form a plurality of shaped body layers, which, in each case, have a liquid-impermeable shaped body casing, in a simple manner, allows a multi-layer construction of the lower layer in accordance with need. The shaped bodies arranged vertically above one another form a plurality of shaped body layers, each of the shaped body layers having their own liquid-impermeable or fluid-impermeable shaped body casing. Each shaped body layer may be formed by one shaped body or a plurality of shaped bodies arranged next to one another in the horizontal direction.

A pad, in which the outer casing as the outer casing upper part comprises a warp-knitted and/or a weft-knitted spacer fabric, has a high degree of sitting and/or lying comfort and breathability. The outer casing preferably has an elastic, two- or three-dimensional warp-knitted spacer fabric and/or weft-knitted spacer fabric, having a height from 1 to 8 mm, preferably 3 to 5 mm.

A pad, comprising a liquid-absorbing and/or sterilizing material layer, which is arranged, in particular, between the upper layer and the lower layer, corresponds to high hygiene requirements. Liquid or moisture can be easily bound by the material layer. The material layer is preferably arranged between the lower layer and the upper layer. The material layer may, for example, be made of nonwoven or another suitable material. Moreover, the material layer may be sterilizing, in other words germ-blocking or germicidal. The material layer is preferably simultaneously moisture-absorbing and sterilizing.

A pad, in which the upper layer has a foam body, which surrounds a warp-knitted spacer fabric or weft-knitted spacer fabric, allows high degree of flexibility in the contouring of the pad. Warp-knitted spacer fabrics and/or weft-knitted spacer fabrics may be produced particularly easily in a rectangular shape. If the contour of the pad is to have a shape differing from a rectangular shape, this shape may be achieved particularly easily by foaming on a foam body surrounding the warp-knitted spacer fabric or the weft-knitted spacer fabric. As a result, for example, seat pads can be produced in any desired form. The upper layer may be used once or repeatedly owing to foam-preserving reprocessing. The production of pads made of warp-knitted spacer mesh fabrics or weft-knitted spacer fabrics in combination with a foam body is economically all the more advantageous, the more complex is the contouring, as, regardless of the contouring, easily producible, plate-like warp-knitted spacer fabrics or weft-knitted spacer fabrics can be used. A high degree of contouring freedom is thereby achieved with low production costs.

The present invention will be explained in more detail below on the basis of drawings, which show exemplary embodiments only. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
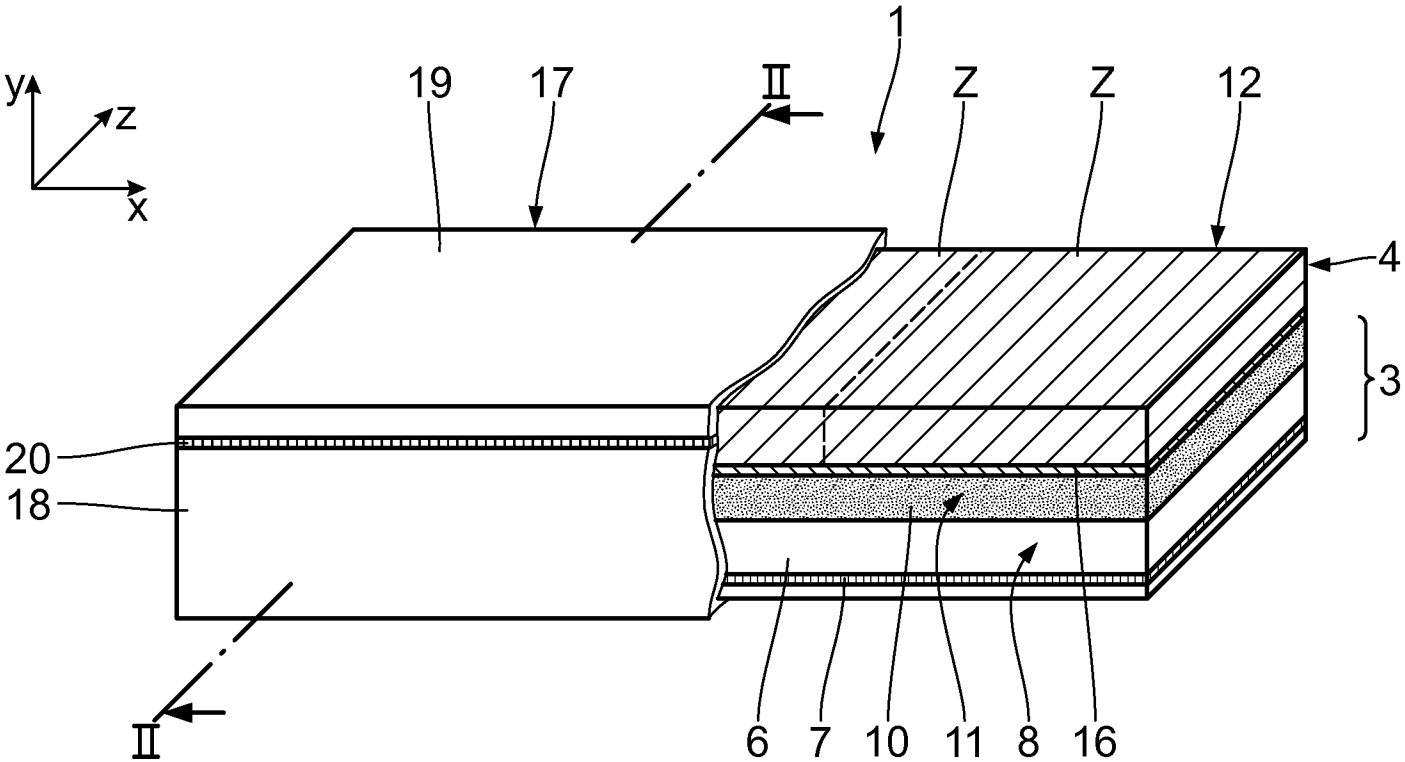
FIG. 1 is a perspective and partially sectional view of a pad for a mattress in the nursing care and hospital sector according to a first embodiment.
Figure 2:
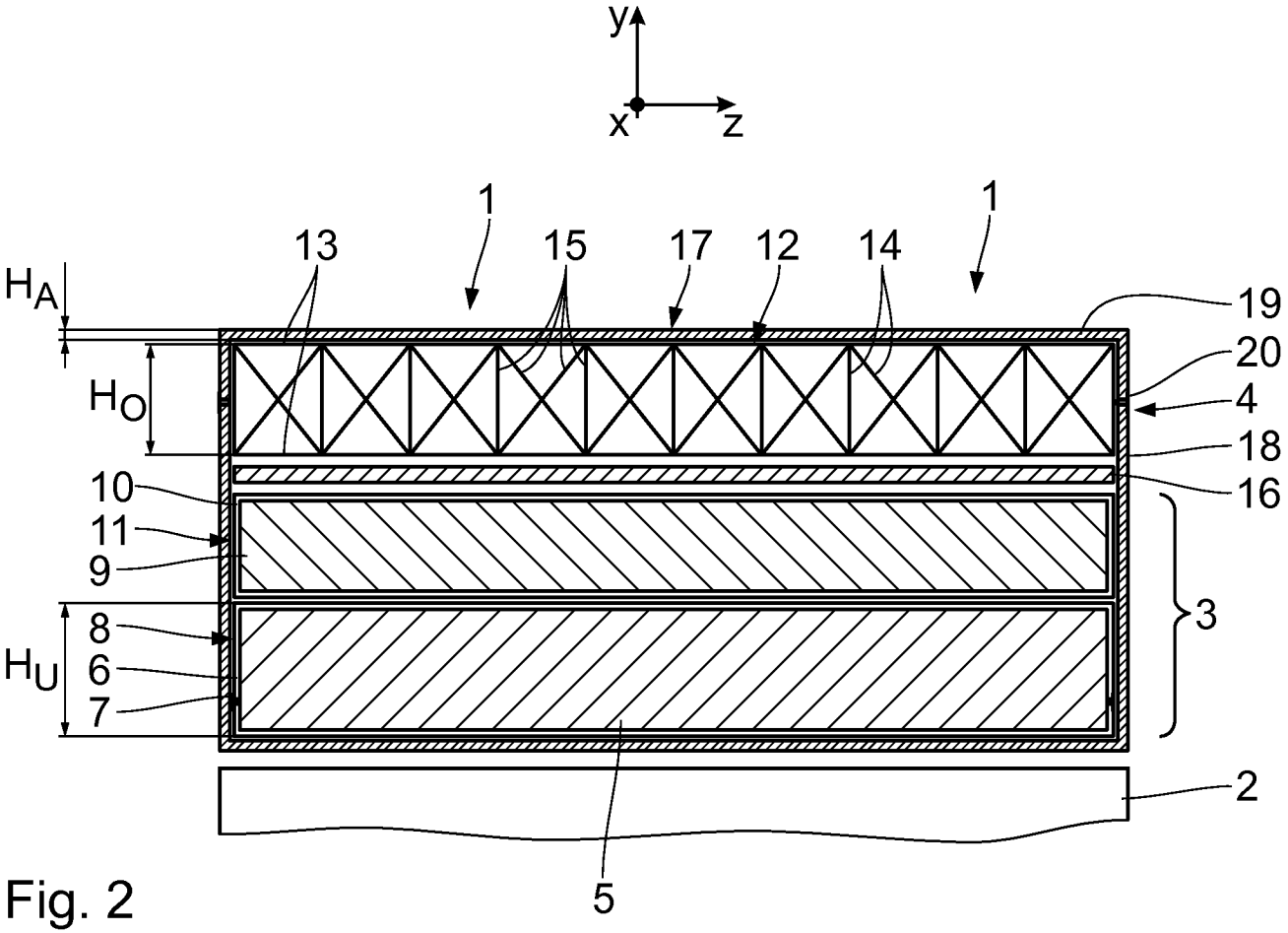
FIG. 2 is a sectional view through the pad in FIG. 1 along the section line II-II.

A first embodiment of the invention will be described below with the aid of FIGS. 1 and 2. A pad 1 for a mattress 2 in the nursing care and hospital sector has a lower layer 3 and an upper layer 4 arranged thereon. The lower layer 3 and the upper layer 4 extend substantially in an x- and a z-direction, the upper layer 4 being arranged in a y-direction on the lower layer 3. The x-, y- and z-directions run perpendicular to one another and form a coordinate system.

The lower layer 3 has a first elastic shaped body 5 made of foam, which is completely surrounded by a first fluid-impermeable or liquid-impermeable shaped body casing 6. The shaped body casing 6 can be removed from the shaped body 5. For this purpose, the shaped body casing 6 has a first zip fastener 7. The shaped body 5, together with the shaped body casing 6, forms a first shaped body layer 8. The first shaped body 5 is, for example, made of reticulated foam and the associated shaped body casing 6 is made of polyurethane (PU) or coated with polyurethane.

Arranged in the y-direction on the first shaped body layer 8 is a second elastic shaped body 9 made of foam, which is surrounded by a second fluid-impermeable or liquid-impermeable shaped body casing 10. The shaped body casing 10 is permanently closed by welding and can accordingly not be removed from the shaped body 9. The shaped body 9, together with the shaped body casing 10, forms a second shaped body layer 11. The lower layer 3 therefore has two shaped body layers 8 and 11. The shaped body 9 is, for example, made of visco-foam and the associated shaped body casing 10 is made of polyurethane or coated with polyurethane.

The lower layer 3, because of the elastics shaped bodies 5 and 9, is, on the one hand, elastic and, because of the shaped body casings 6 and 10, is, on the other hand fluid-impermeable or liquid-impermeable. The shaped body casings 6 and 10 are also elastic. The lower layer 3 has, for each of the shaped body layers 8 and 11, a height $H_U$ of 30 to 200 mm, in particular from 50 to 150 mm and, in particular, from 70 to 120 mm.

The upper layer 4 is formed by a spacer textile 12 in the form of a warp-knitted spacer fabric. Alternatively, the spacer textile fabric 12 may be configured as a weft-knitted spacer fabric. The spacer textile 12 configured as a knitted spacer fabric will be described in more detail below.

The knitted spacer fabric 12 has two covering layers 13 which extend substantially parallel to one another and are connected to one another by spacer threads 14. The spacer threads 14 form spacer thread groups 15, which run in a plane and have an IXI-shape. This is shown in FIG. 2. The IXI-shape is formed by two spacer threads 14 running perpendicular to the covering layers 13 and two spacer threads 14 which intersect and run obliquely, for example at an angle of 45°. The knitted spacer fabric 12 has a height $H_O$ in the range from 2 to 100 mm, in particular from 5 to 80 mm, in particular from 15 to 60 mm and, in particular, from 20 to 50 mm. The threads of the covering layers 13 and/or the spacer threads 14 may be configured as monofilaments and/or multifilaments and consist, for example of polyester. With regard to the construction and the material of the knitted spacer fabric 12 reference is made to DE 100 26 405 B4.

The knitted spacer fabric 12 is elastic and fluid-permeable or liquid-permeable and forms the upper layer 4. The knitted spacer fabric 12 is distinguished by good pressure relief and pressure distribution and high pumping elasticity. Owing to the open structure of the knitted spacer fabric 12, liquids are guided away into the interior from a lying surface remote from the lower layer 3. For example, body liquids of patients are guided away from the body. Moreover, the knitted spacer fabric 12 has a good microclimate and good heat and moisture exchange, as it acts as a passive pump and, for example, allows oxygen to be supplied and removed upon a body movement. The knitted spacer fabric 12 can be completely recycled with a corresponding choice of material.

The knitted spacer fabric 12 is divided into a plurality of zones Z which are arranged next to one another in the x-direction and/or z-direction. The zones Z have different densities from one another so that—depending on need—different compression hardnesses of the knitted spacer fabric 12 are formed. The density of each of the zones Z is homogeneous per se.

A moisture-absorbing and sterilizing material layer 16 is arranged between the lower layer 3 and the upper layer 4. The material layer 16 absorbs liquid, which passes through the knitted spacer fabric 12 and substantially kills germs contained therein.

The lower layer 3, the upper layer 4 and the material layer 16 are completely surrounded by the outer casing 17. The outer casing 17 has an outer casing lower part 18 facing the lower layer 3 and an outer casing upper part 19 facing the upper layer 4. The outer casing lower part 18 is connected to the outer casing upper part 19 by a second zip fastener 20, so the outer casing 17 can be removed from the lower layer 3 or the upper layer 4.

The outer casing lower part 18 is configured as a fluid-impermeable or liquid-impermeable trough to avoid liquid escaping laterally. The outer casing lower part 18 consists, for example, of polyurethane or polyester with an outer PU coating. The outer casing lower part 18 preferably has fluid-impermeable side cheeks, which extend to the height of the zip fastener 20. The outer casing upper part 19 forming the lying surface is fluid-permeable, in other words liquid-permeable and air-permeable. The outer casing upper part 19 is preferably an elastic warp-knitted spacer fabric and/or weft-knitted spacer fabric, which, depending on the position of the zip fastener 20, is two-dimensional or three-dimensional. The outer casing 17 or the outer casing upper part 19 has, for example, a height $H_A$ of 1 to 8 mm and in particular from 3 to 5 mm.

The outer casing upper part 19 provides a lying surface, for example for a patient in a hospital. Liquids located on the outer casing upper part 19 pass through the latter into the interior of the outer casing 17 and from there into the interior of the knitted spacer fabric 12. The liquid leaving the knitted spacer fabric 12 is substantially absorbed by the material layer 16. The liquid that has not been absorbed collects in the outer casing lower part 18, the latter preventing liquid escaping owing to the trough-shaped and fluid-impermeable configuration. The liquid cannot soil the shaped bodies 5 and 9 because of the fluid-impermeable shaped body casings 6 and 10.

To reprocess the pad 1, the zip fastener 20 is opened and the knitted spacer fabric 12, the material layer 16 and the shaped body layers 8 and 11 removed. The shaped body layers 8 and 11 only have to be cleaned externally because of the fluid-impermeable shaped body casings 6 and 10. Regardless of this, the shaped body 5 can be exchanged or cleaned by opening the zip fastener 7. The knitted spacer fabric 12, the material layer 16 and the outer casing 17 can be cleaned separately from one another. If the soiling is too heavy or wear that is too heavy because of frequent reprocessing has occurred, the knitted spacer fabric 12, and the material layer 16 and/or the outer casing 17 can be replaced.

The pad 1 has a high degree of lying comfort and a high degree of breathability. The pad 1 can be easy and frequently reprocessed owing to the structure thereof. Moreover, conventional mattresses 2 can be easily and economically retrofitted by means of the pad 1, so their lying comfort and breathability is improved.

Figure 3:
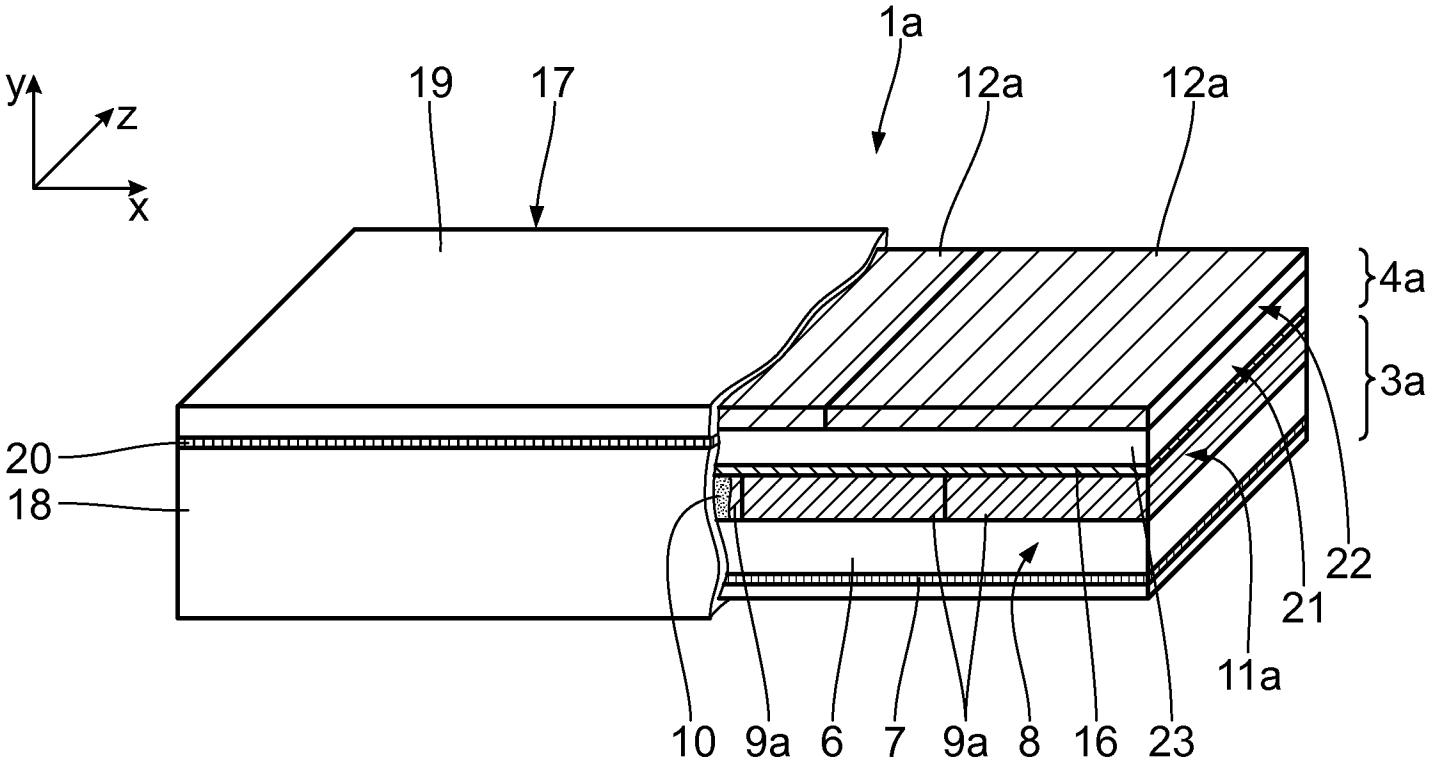
FIG. 3 is a perspective and partially sectional view of a pad for a mattress in the nursing care and hospital sector according to a second embodiment.

A second embodiment of the invention will be described below with reference to FIG. 3. Structurally identical parts have the same reference numerals as in the first embodiment, to the description of which reference is hereby made. Structurally different but functionally similar parts have the same reference numerals with an a placed thereafter. In contrast to the first embodiment, the upper layer 4*a* of the pad 1*a* has two spacer textile layers 21 and 22 arranged above one another in the y-direction. The spacer textile layers 21 and 22 are formed from a plurality of knitted spacer fabrics 12*a* and 23. Alternatively or in addition, the spacer textile layers 21 and 22 may be formed from knitted spacer fabrics.

The first spacer textile layer 21 is a knitted spacer fabric 23 which is continuous in the x- and z-direction. The knitted spacer fabric 23 has the construction described in conjunction with the first embodiment. The spacer knitted fabric 23 may have one or more zones Z.

The second spacer textile layer 22 is formed by a plurality of knitted spacer fabrics 12*a* arranged next to one another in the x-direction. The knitted spacer fabrics 12*a* are connected to one another, for example by a zip fastener or a hook and loop fastener. The knitted spacer fabrics 12*a* have different compression hardnesses. Moreover, the knitted spacer fabrics 12*a* are arranged in a shear-resistant manner on the knitted spacer fabric 23. The knitted spacer fabrics 12*a* and 23 are fluid-permeable and elastic in the manner described.

Furthermore, the second shaped body layer 11*a* has a plurality of second shaped bodies 9*a* arranged next to one another in the x-direction, which are completely surrounded by a common second shaped body casing 10. The shaped bodies 9*a* have different compression hardnesses. With regard to the further structure and the further mode of functioning, reference is made to the first embodiment.

Figure 4:
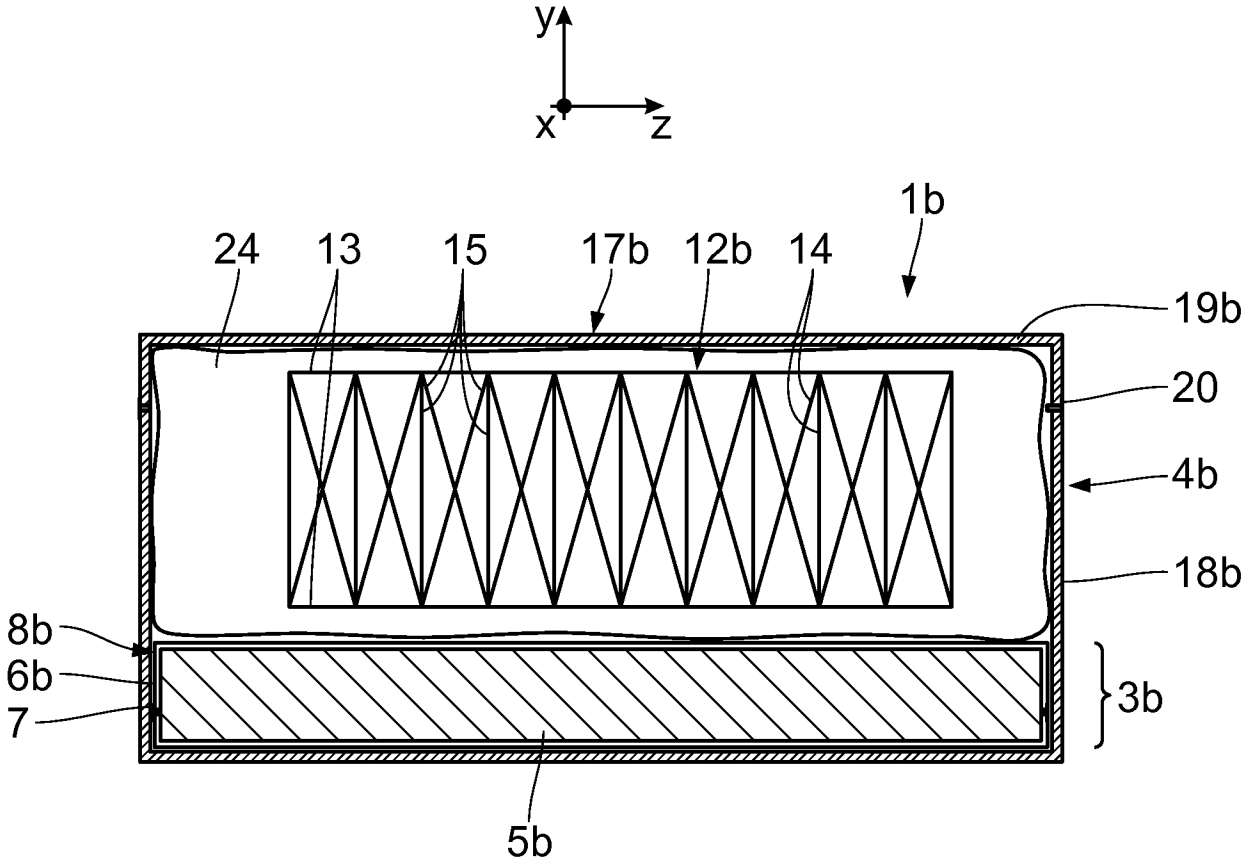
FIG. 4 is a sectional view through a pad for use as a seat cushion according to a third embodiment.

A third embodiment of the invention will be described below with reference to FIG. 4. Structurally identical parts have the same reference numerals as the previous embodiments, to the description of which reference is hereby made. Structurally different but functionally similar parts have the same reference numerals with a b placed thereafter. In contrast to the previous embodiments, the pad 1*b* is configured as a seat cushion. The pad 1*b*, for this purpose, has a non-rectangular, for example circular form. The shaped body 5*b* and the shaped body casing 6*b* of the lower layer 3*b* are configured in accordance with this form.

The rectangular knitted spacer fabric 12*b* is surrounded by a foam body 24, which adapts the rectangular form of the knitted spacer fabric 12*b* to the non-rectangular form of the pad 1*b*. The foam body 24 and the knitted spacer fabric 12*b* are elastic and fluid-permeable. Reference is made to the previous embodiments with regard to the further structure and further mode of functioning.

While specific embodiments of the invention have been shown and described in detail to illustrate the application of the principles of the invention, it will be understood that the invention may be embodied otherwise without departing from such principles.

The invention claimed is:

1. A pad, comprising:

a liquid-impermeable and elastic lower layer;

a liquid-permeable and elastic upper layer arranged on the lower layer;

an outer casing covering the lower layer and the upper layer, said outer casing comprising a liquid-impermeable outer casing lower part facing the lower layer and a liquid-permeable outer casing upper part facing the upper layer, wherein the outer casing lower part is configured in the form of a trough, wherein the upper layer has at least one spacer textile.

2. A pad according to claim 1, wherein the upper layer has at least one knitted spacer fabric, which has two covering layers connected to one another by spacer threads, wherein the spacer threads form thread groups running in a plane, with an IXI-shape.

3. A pad according to claim 1, wherein the upper layer has a plurality of at least one of warp-knitted spacer fabrics and weft-knitted spacer fabrics, which are at least one of arranged horizontally next to one another and arranged vertically above one another.

4. A pad according to claim 1, wherein the upper layer has at least one of at least one warp-knitted spacer fabric and a weft-knitted spacer fabric, which, in a horizontal direction, has a plurality of zones with different densities in such a way that the zones have different compression hardnesses.

5. A pad according to claim 1, wherein the lower layer has at least one elastic shaped body, which is surrounded by at least one liquid-impermeable shaped body casing.

6. A pad according to claim 5, wherein the shaped body is made of foam.

7. A pad according to claim 5, wherein the shaped body casing is permanently closed.

8. A pad according to claim 5, wherein the shaped body casing is removable from the shaped body.

9. A pad according to claim 1, wherein the lower layer has a plurality of elastic shaped bodies, which are at least one of arranged horizontally next to one another and arranged vertically above one another.

10. A pad according to claim 9, wherein the shaped bodies arranged vertically above one another form a plurality of shaped body layers, which, in each case, have a liquid-impermeable shaped body casing.

11. A pad according to claim 1, wherein the outer casing as the outer casing upper part comprises at least one of a warp-knitted spacer fabric and a weft-knitted spacer fabric.

12. A pad according to claim 1, further comprising:

at least one of a liquid-absorbing layer and a sterilizing material layer.

13. A pad according to claim 1, wherein the upper layer has a foam body, which surrounds one of a warp-knitted spacer fabric and a weft-knitted spacer fabric.

14. A pad according to claim 1, wherein the pad is provided for a mattress in a nursing care and hospital sector.

15. A pad according to claim 1, wherein the upper layer has at least one of a warp-knitted spacer fabric and a weft-knitted spacer fabric.

16. A pad according to claim 5, wherein the shaped body casing has a zip fastener for removal from the shaped body.

17. A pad according to claim 12, wherein the at least one of said liquid-absorbing layer and sterilizing material layer is arranged between the upper layer and the lower layer.

18. A pad, comprising:

a liquid-impermeable and elastic lower layer;

a liquid-permeable and elastic upper layer arranged on the lower layer;

an outer casing covering the lower layer and the upper layer, said outer casing comprising a liquid-impermeable outer casing lower part facing the lower layer and a liquid-permeable outer casing upper part facing the upper layer, wherein the outer casing lower part is configured in the form of a trough, said lower layer having at least one elastic shaped body, which is surrounded by at least one liquid-impermeable shaped body casing, said shaped body being made of foam.

19. A pad, comprising:

a liquid-impermeable and elastic lower layer;

a liquid-permeable and elastic upper layer arranged on the lower layer;

an outer casing covering the lower layer and the upper layer, said outer casing comprising a liquid-impermeable outer casing lower part facing the lower layer and a liquid-permeable outer casing upper part facing the upper layer, wherein the outer casing lower part is configured in the form of a trough, said lower layer having a plurality of elastic shaped bodies, which are at least one of arranged horizontally next to one another and arranged vertically above one another.

* * * * *

UNITED STATES PATENT AND TRADEMARK OFFICE

CERTIFICATE OF CORRECTION

PATENT NO. : 9,072,639 B2
APPLICATION NO. : 13/575721
DATED : July 7, 2015
INVENTOR(S) : Essers It is certified that error appears in the above-identified patent and that said Letters Patent is hereby corrected as shown below:

On the title page item (30), Foreign Application Priority Data

DE 10 2010 002 572.0, Germany date is March 4, 2010
Please change date from April 3, 2010 to March 4, 2010.

Signed and Sealed this
Tenth Day of November, 2015

Michelle K. Lee

Michelle K. Lee
*Director of the United States Patent and Trademark Office*